US011110711B2

(12) United States Patent
Nakamura

(10) Patent No.: US 11,110,711 B2
(45) Date of Patent: Sep. 7, 2021

(54) LIQUID AGENT MIST RECOVERY DEVICE

(71) Applicant: RISO KAGAKU CORPORATION, Tokyo (JP)

(72) Inventor: Shunta Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/794,671

(22) Filed: Feb. 19, 2020

(65) Prior Publication Data

US 2020/0262207 A1 Aug. 20, 2020

(30) Foreign Application Priority Data

Feb. 20, 2019 (JP) ..... JP2019-028039

(51) Int. Cl.
*B41J 2/17* (2006.01)
*B41J 2/185* (2006.01)
(Continued)

(52) U.S. Cl.
CPC ..... *B41J 2/1714* (2013.01); *B41J 2/18* (2013.01); *B41J 2/185* (2013.01); *B41J 29/02* (2013.01); *B41J 2002/1853* (2013.01)

(58) Field of Classification Search
CPC ... B41J 2/1714; B41J 29/02; B41J 2/18; B41J 2/185; B41J 2002/1853; B41J 2/01; B41J 29/17
See application file for complete search history.

(56) References Cited

U.S. PATENT DOCUMENTS 9,315,037 B2 * 4/2016 Gasso Puchal .... B01D 46/0041
2013/0229460 A1 9/2013 Masuda
(Continued)

FOREIGN PATENT DOCUMENTS

EP 3 072 694 A2 9/2016
EP 3 072 694 A3 12/2016
(Continued)

OTHER PUBLICATIONS

European Search Report, European Patent Office, Application No. 20158529.6, dated Jun. 24, 2020.

*Primary Examiner* — Geoffrey S Mruk
(74) *Attorney, Agent, or Firm* — Greenblum & Bernstein, P.L.C.

(57) ABSTRACT

A liquid agent mist recovery device for a liquid agent application device prevents dripping of a droplet formed from a sucked liquid agent mist onto a sheet. The ink mist recovery device installed downstream of an inkjet head includes a recovery casing with an opening for introducing the mist. The opening is communicated with a recovery hole connected to a suction fun, and positioned apart from an upstream wall surface by a distance corresponding to receiving portions for receiving a droplet trickling from the wall surface, and apart from a downstream wall surface so that air introduced from downstream obstructs the flow of the upstream liquid agent mist for guiding into the recovery hole. The liquid agent mist from upstream is securely introduced and recovered. The liquid agent mist trickling from the wall surface of the recovery hole is received by the receiving portion rather than dripping onto the sheet.

6 Claims, 3 Drawing Sheets

(51) Int. Cl.
*B41J 29/02* (2006.01)
*B41J 2/18* (2006.01)

(56) References Cited

U.S. PATENT DOCUMENTS

| | | | |
|---|---|---|---|
| 2014/0240397 | A1 | 8/2014 | Norihiro |
| 2015/0085014 | A1 | 3/2015 | Ishida et al. |
| 2015/0165770 | A1 | 6/2015 | Miyakoshi et al. |
| 2016/0031218 | A1 | 2/2016 | Ishida et al. |
| 2019/0009567 | A1 | 1/2019 | Miyakoshi et al. |

FOREIGN PATENT DOCUMENTS

| | | |
|---|---|---|
| EP | 3 290 212 | 3/2018 |
| JP | 2015-134496 | 7/2015 |

* cited by examiner

LIQUID AGENT MIST RECOVERY DEVICE

BACKGROUND OF THE INVENTION

The present invention relates to a liquid agent mist recovery device that is installed in a liquid agent application device for discharging the liquid agent to a sheet being carried, and is configured to allow a suction unit to introduce the liquid agent mist generated during discharge of the liquid agent into a duct for recovery. Particularly, the present invention relates to the liquid agent mist recovery device capable of preventing a droplet formed from the introduced liquid agent mist from dripping onto the sheet.

Japanese Unexamined Patent Application Publication No. 2015-134496 discloses the ink mist recovery device intended to suppress adhesion of the ink mist to the inner surface of the suction flow path. As FIG. 2 of the disclosure shows, the ink mist recovery section 3 is disposed apart from the recording head 1 downstream at a predetermined gap in a carrier direction Y of the recording medium 5. The ink mist recovery section 3 sucks air above the recording medium 5 together with the ink mist M from the suction port 4 that faces the recording medium 5 through the suction passage 10. The gas is blown from the outlet port 9 to the inside of the suction passage 10.

SUMMARY OF THE INVENTION

In the ink mist recovery device disclosed in Japanese Unexamined Patent Application Publication No. 2015-134496, as FIG. 2B shows, the ink mist M introduced from the suction port 4 of the ink mist recovery section 3 adheres to the inner surface of the suction passage 10, and gathers thereon to drip as an ink droplet ml onto the recording medium 5 by gravity.

The above-described problem of the contactless type liquid application device for discharging the liquid agent to be applied to the sheet generally involves, regardless of the purpose, the technique for sucking the liquid agent mist generated in the discharge.

The present invention has been made considering the above-described circumstances to provide a liquid agent mist recovery device that is installed in the contactless liquid agent application device for suction and recovery of the liquid agent mist. It is an object of the invention to provide the liquid agent mist recovery device capable of preventing the droplet caused by the sucked liquid agent mist from dripping onto the sheet.

The liquid agent mist recovery device according to a first aspect of the invention is provided for a liquid agent application device that allows a discharge unit to discharge a liquid agent to a sheet carried in a carrier direction. The liquid agent mist recovery device is disposed at a downstream side of the discharge unit in the carrier direction, and includes a recovery casing including an opening for introducing a liquid agent mist generated when the discharge unit discharges the liquid agent together with air, and a recovery hole communicated with the opening, and a suction unit that is connected to the recovery hole of the recovery casing, and introduces the liquid agent mist together with air from the opening. The opening is apart from an upstream wall surface and a downstream wall surface of the recovery hole by an amount equal to or larger than a width of a receiving portion for receiving the liquid agent trickling from the upstream wall surface and the downstream wall surface.

The liquid agent mist is generated when the discharge unit of the liquid agent application device discharges the liquid agent. The liquid agent mist then flows downstream. The liquid agent mist recovery device disposed at the downstream side of the liquid agent application device is capable of introducing the liquid agent mist into the recovery hole of the recovery casing with the suction force of the suction unit. The introduced liquid agent mist adheres to the wall surface of the recovery hole, and gathers thereon to trickle as the droplet. Even in the case as described above, the droplet may be received by receiving portions. This makes it possible to prevent the droplet from directly dripping onto the sheet.

DETAILED DESCRIPTION OF THE PREFERRED EMBODIMENTS

An embodiment of the present invention will be described referring to FIGS. 1 to 4. This embodiment relates to an inkjet printer 1 provided with an ink mist recovery device 100. The ink mist recovery device 100 is one specific example of the liquid agent mist recovery device according to the present invention. The inkjet printer 1 is a preferred example to which the ink mist recovery device is applied.

Figure 1:
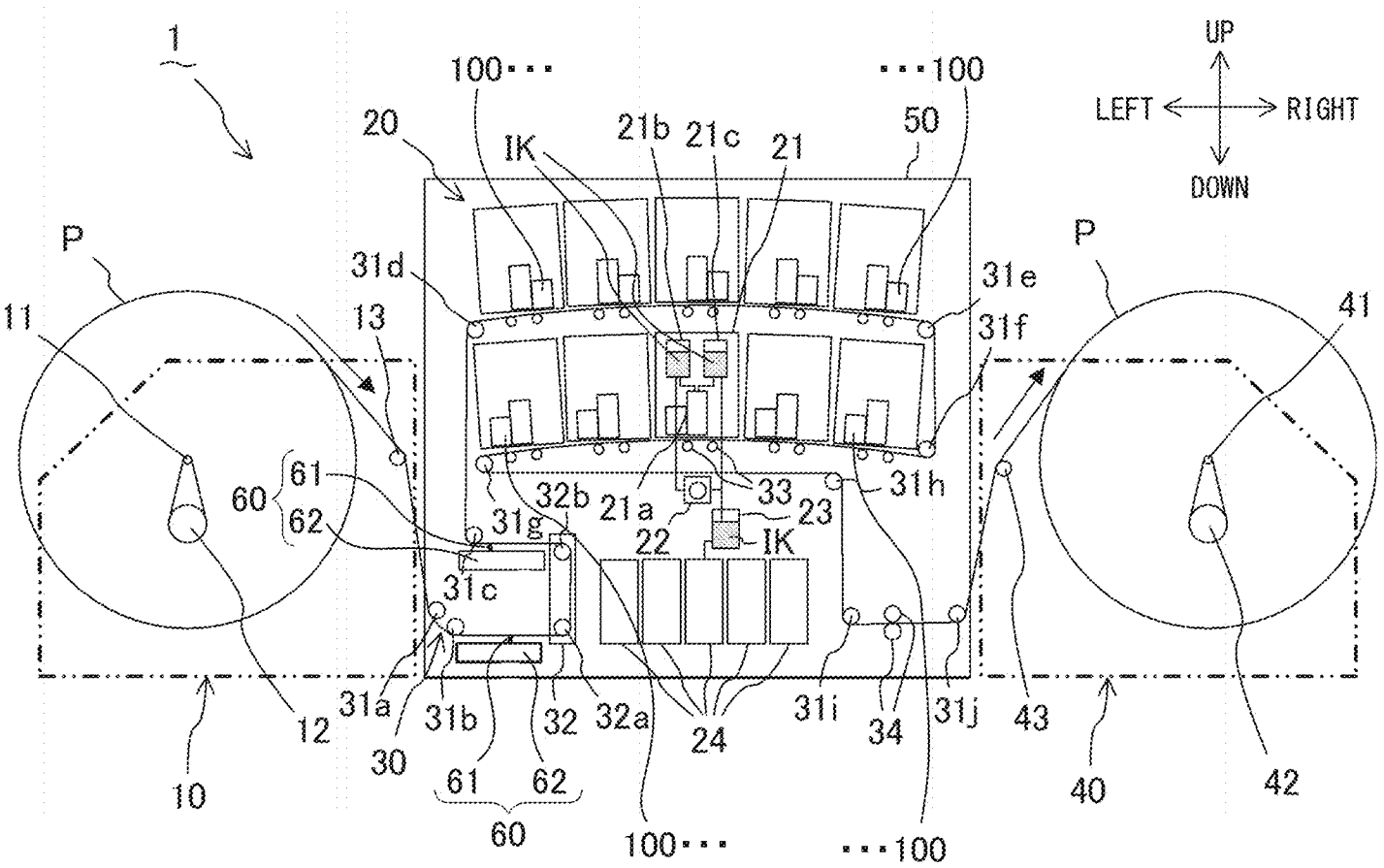
FIG. 1 is an overall structure view of an inkjet printer according to an embodiment.

FIG. 1 is an overall structure view of the inkjet printer 1 according to the embodiment in a front view. Descriptions indicating directions such as an up-down direction, a left-right direction (those two directions are indicated by arrows in FIG. 1), and a front-rear direction (direction perpendicular to the drawing) are mere terms for convenience of explanation. Specifically, the up-down direction refers to the vertical direction. The left-right and the front-rear directions refer to those orthogonal to each other in the horizontal plane.

As FIG. 1 shows, the inkjet printer 1 includes an unwinding unit 10 as a sheet feeder for feeding a continuous sheet P, a print section 20 for printing the continuous sheet P fed from the unwinding unit 10, an ink mist recovery device 100 installed in the print section 20, a carrier section 30 for carrying the continuous sheet P, a winding unit 40 as a winder for winding the printed continuous sheet P, a casing 50, and two dust removers 60. The ink mist recovery device 100 will be described later in detail.

The inkjet printer 1 as shown in FIG. 1 is configured to perform printing on the long belt-like continuous sheet P as a web (rolled sheet) wound in a roll state. The continuous sheet P is an example of a continuous medium. The continuous medium may take an arbitrary form such as a film other than paper. The inkjet printer 1 allows the unwinding unit 10 and the winding unit 40 to be separately disposed. In other words, the inkjet printer 1 may be configured to exclude the unwinding unit 10 and the winding unit 40. The unwinding unit 10 and the winding unit 40 may be installed in the print section 20 as separate retrofit units. A printing method is not limited to the inkjet printing method.

As FIG. 1 shows, the unwinding unit 10 includes a roll support shaft 11, a brake 12, and a guide roller 13. The roll support shaft 11 rotatably supports the rolled continuous sheet P. The rolled continuous sheet P is unwound while being rotated with the roll support shaft 11. The brake 12 is a unit for braking the rotation of the roll support shaft 11, for example, a power brake. As the brake 12 applies braking force to the rotation of the roll support shaft 11, the tension is applied to the continuous sheet P between the rolled continuous sheet P and a carrier roller pair 34 to be described later. The guide roller 13 guides the unwound continuous sheet P in a longitudinal direction (axial direction) as the front-rear direction. The unwinding unit 10 further includes a frame indicated by a two-dot chain line, and a motor (not shown) for driving the brake 12.

As FIG. 1 shows, the print section 20 includes a head unit 21, a circulation pump 22, a sub-tank 23, and ink supplying tanks 24. The print section 20 is disposed in the casing 50. There are ten head units 21, ten circulation pumps 22, and ten sub-tanks 23, respectively corresponding to, for example, five colors for surface printing and five colors for back surface printing. There are five ink supplying tanks 24 corresponding to, for example, five colors, respectively. An ink IK has colors of black (K), cyan (C), magenta (M), yellow (Y), and a reserve color as arbitrary color such as red, light cyan, and gray.

The head unit 21 includes an inkjet head 21*a* as a discharge unit, a pressure tank 21*b*, and a negative pressure tank 21*c*. Each of 10 head units 21 is detachably arranged in the inkjet printer 1.

The ink IK is supplied to the negative pressure tank 21*c* from the ink supplying tank 24 via the sub-tank 23. The ink IK that has not been consumed by the inkjet head 21*a* is resupplied thereto by the circulation pump 22 via the negative pressure tank 21*c* and the pressure tank 21*b*. As described above, the print section 20 is configured as a circulation type for circulating the ink IK. However, the print section 20 may be configured as a non-circulation type.

As FIG. 1 shows, the carrier section 30 includes guide rollers 31*a* to 31*j* each as a carrier unit, a meandering control unit 32, a support member 33, and the carrier roller pair 34. The carrier section 30 is disposed in the casing 50.

The guide rollers 31*a* to 31*j* guide the continuous sheet P unwound from the unwinding unit 10 in the casing 50 in the longitudinal direction (axial direction) as the front-rear direction. The guide rollers 31*a*, 31*b* guide the continuous sheet P between the unwinding unit 10 and the meandering control unit 32. The guide rollers 31*c* to 31*i* guide the continuous sheet P between the meandering control unit 32 and the carrier roller pair 34. The guide roller 31*j* guides the continuous sheet P between the carrier roller pair 34 and the winding unit 40.

The meandering control unit 32 includes meandering control rollers 32*a*, 32*b* for correcting meandering of the continuous sheet P. The front-rear direction with respect to the meandering control rollers 32*a*, 32*b* corresponds to the longitudinal direction (axial direction). Based on the meandering state of the continuous sheet P detected by an unshown sensor, the meandering control unit 32 adjusts an inclination of the continuous sheet P to the front-rear direction.

Two support members 33 are disposed below each of the head units 21 in the longitudinal direction (axial direction) as the front-rear direction. Ten support members 33 disposed between the guide rollers 31*d* and 31*e*, and ten support members 33 disposed between the guide rollers 31*f* and 31*g* are arranged to form protrusive curves upward, respectively. The tensile force is applied to the continuous sheet P between the guide rollers 31*d* and 31*e*, and the guide rollers 31*f* and 31*g*, respectively to keep the stable position.

The carrier roller pair 34 is driven by an unshown motor (an example of a carrier drive unit (actuator)) to carry the continuous sheet P while being nipped.

As FIG. 1 shows, the winding unit 40 includes a winding shaft 41, a winding motor 42, and a guide roller 43. The winding shaft 41 winds up the continuous sheet P in the roll state. The wound continuous sheet P is subjected to post treatment such as cutting. The winding motor 42 is another example of the carrier drive unit (actuator) for rotating the winding shaft 41 clockwise in FIG. 1. The guide roller 43 guides the continuous sheet P just before it is wound up by the winding shaft 41 in the longitudinal direction (axial direction) as the front-rear direction. The winding unit 40 further includes a frame indicated by the two-dot chain line.

As FIG. 1 shows, two dust removers 60, 60 are installed in the inkjet printer 1. The two dust removers 60, 60 are disposed in a predetermined space at a left lower side in the casing 50 of the inkjet printer 1. The two dust removers 60, 60 are vertically arranged at the upstream side and the downstream side of the carrier direction F of the continuous sheet P so that both lower and upper surfaces of the continuous sheet P come into contact with those dust removes, respectively.

The dust remover 60 includes a dust removing unit 61 as a brush in contact with the lower surface of the continuous sheet P to remove the dust therefrom, and a tray-like dust receiving unit 62 to which the dust removing unit 61 is attached for receiving the dust removed by the dust removing unit 61 from the continuous sheet P. The dust remover 60 is movable between a cleaning position (refer to FIG. 1) and a release position. At the cleaning position, the dust removing unit 61 comes into contact with the lower surface of the continuous sheet P. At the release position, the dust removing unit 61 is released from the lower surface of the continuous sheet P as a result of movement of the dust removing unit 61 and the dust receiving unit 62 in the direction perpendicular to the drawing to the outside of the casing 50.

As FIG. 1 shows, in the print section 20 as described above, the ink mist recovery devices 100 are adjacently disposed at the downstream side of the respective head units 21 in the carrier direction F of the continuous sheet P. The ink mist recovery device 100 will be described referring to FIG. 2.

Figure 2:
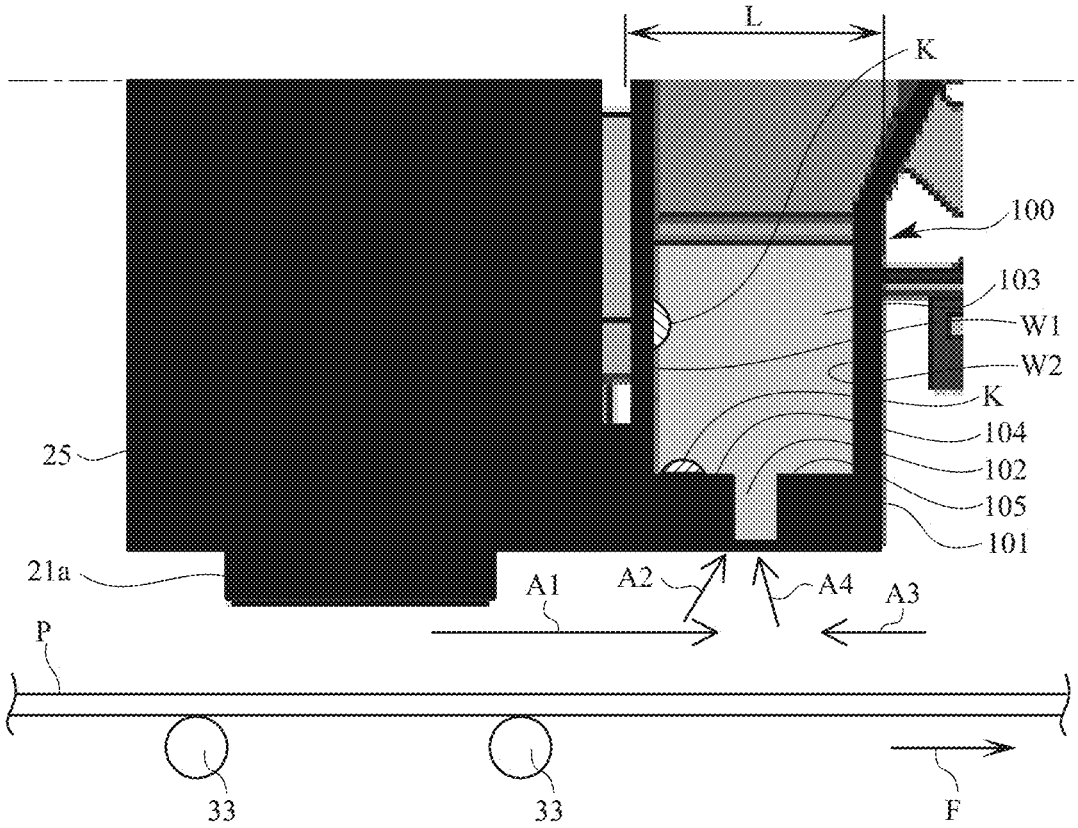
FIG. 2 is a sectional view of the ink mist recovery device installed in the inkjet printer according to the embodiment, taken along a vertical plane parallel to a sheet carrier direction.

FIG. 2 is an enlarged sectional view of a lower half part of one of five head units 21 arranged on the upper stage where the continuous sheet P as shown in FIG. 1 is transferred from left to right as seen from the same direction as that of FIG. 1. The head unit 21 includes the inkjet head 21*a* disposed upstream, and the ink mist recovery device 100 disposed downstream in a carrier direction F (from left to right) of the continuous sheet P as indicated by an arrow.

The inkjet head 21*a* as shown in FIG. 2 is held by a head holder 25, and has its lower end portion protruding downward from the lower surface of the head holder 25. The ink mist recovery device 100 and the head holder 25 are arranged laterally without a gap therebetween. The lower surface of the ink mist recovery device is continuous with the lower surface of the head holder 25. Those lower surfaces are substantially flush with each other.

As FIG. 2 shows, the ink mist recovery device 100 includes a recovery casing 101 disposed above the continuous sheet P to be carried. The recovery casing 101 is a thin hollow box with a length equal to or slightly longer than the width (length in the direction perpendicular to the drawing of FIG. 2) of the continuous sheet P, and a dimension (thickness) in the carrier direction F which is smaller compared with the length.

A reference sign L shown in FIG. 2 denotes a dimension (thickness) of the lower part of the recovery casing 101 in the carrier direction F of the continuous sheet P. A continuous slit-like opening 102 in the width direction (direction perpendicular to the drawing of FIG. 2) of the continuous sheet P is formed in the lower surface of the recovery casing 101 at the center of the length L in the carrier direction F. A recovery hole 103 communicated with the opening 102 is formed in the recovery casing 101. The dimension of the recovery hole 103 in the carrier direction F is approximately four to five times larger than the dimension of the opening 102 in the carrier direction F. Although not shown, a suction unit such as a suction fan is connected to the recovery hole 103. By driving the suction unit, the ink mist generated upon discharge of the ink from the inkjet head 21*a* is introduced into the recovery hole 103 from the opening 102 together with air to reach the suction unit where the ink mist is recovered.

As described referring to FIG. 2, the dimension of the opening 102 of the recovery casing 101 is smaller than that of the recovery hole 103 formed in the recovery casing 101 in the carrier direction F. The opening 102 is formed at the center of the dimension L in the carrier direction F, and apart from a wall surface W1 (left-side wall surface in FIG. 2) at the upstream side of the recovery hole 103 to the downstream direction by a predetermined distance. A receiving portion 104 with the height equivalent to the height of the opening 102 (dimension in the up-down direction in FIG. 2) is formed horizontally between the opening 102 and the wall surface W1. A similar receiving portion 105 is formed between a wall surface W2 (right-side wall surface in FIG. 2) at the downstream side of the recovery hole 103 and the opening 102.

When the inkjet printer 1 is activated to allow the inkjet head 21*a* to discharge the ink to the continuous sheet P, a large quantity of fine ink mist is generated between the inkjet head 21*a* and the continuous sheet P. As FIG. 2 shows an air flow (air current) indicated by an arrow A1, the ink mist at the upstream side of the ink mist recovery device 100 is transferred downstream together with the air flow directed downstream with the suction force of the suction unit. The ink mist is further introduced into the recovery hole 103 from the opening 102 as indicated by an arrow A2. The air flow from the ink jet head 21*a* to the ink mist recovery device 100 as indicated by the arrow A1 flows along the continuous lower surfaces of the inkjet head 21*a* and the ink mist recovery device 100 which are laterally arranged without a gap therebetween. As a result, the swirling that obstructs smooth transfer of the ink mist hardly occurs. The resultant flow as a stable straight flow is capable of securely transferring the ink mist to the opening 102. However, the opening 102 of the ink mist recovery device 100 is formed at a position apart from the upstream wall surface via the receiving portion 104 to the downstream direction. Since the suction force is not strong, unfavorable phenomena hardly occur, for example, change in the discharge path of the ink droplet from the upstream inkjet head 21*a* and suction of the ink droplet to be introduced from the opening 102.

If there is a gap between the inkjet head 21*a* and the ink mist recovery device 100, the air flow containing the ink mist infiltrates into the gap to generate the ink droplet. The ink droplet then drips onto the continuous sheet P. In the embodiment, such failure hardly occurs. If the lower surfaces of the inkjet head 21*a* and the ink mist recovery device 100 are not continuously connected, the air turbulence such as swirling occurs in the air flow as indicated by the arrow A1, thus interfering with suction and recovery of the ink mist. In the embodiment, such failure hardly occurs. In this embodiment, the lower surface of the inkjet head 21*a* is flush with the lower surface of the ink mist recovery device 100. However, the lower surfaces do not have to be flush with each other. Although the lower surfaces of those components are not flush with each other, they may be regarded as being substantially continuous so long as the lower surfaces are curvedly or inclinedly continuous, or the stepped part between the lower surfaces is so small that the air current turbulence hardly occurs.

The suction force of the suction unit applied to the opening 102 generates the air current flowing from downstream to upstream as indicated by an arrow A3 in FIG. 2. The air current is not strong enough to cause the ink mist generated by the not shown inkjet head 21*a* at the downstream side of the ink mist recovery device 100 to be introduced upstream. However, such air current prevents the ink mist carried by the air current from upstream as indicated by the arrow A1 from flowing downstream via the ink mist recovery device 100 by blowing the upstream ink mist upward for guiding into the recovery hole 103 as indicated by the arrows A3, A4.

As FIG. 2 shows, the ink mist introduced into the recovery hole 103 may adhere to the wall surface of the recovery hole 103, and gather thereon to trickle as an ink droplet K. In such a case, the ink droplet K that trickles along the wall surface W1 is received by the receiving portion 104 to prevent the droplet K from directly dripping onto the continuous sheet P. This may prevent deterioration in the printing quality. The downstream receiving portion 105 between the opening 102 and the downstream wall surface W2 provides a similar effect, that is, the ink droplet K trickling along the wall surface is received by the receiving portion to prevent the droplet K from dripping onto the continuous sheet P. Each length (receiving width) of the upstream and downstream receiving portions 104, 105 in the carrier direction F has to be set to the value sufficient to maintain the state where the received ink droplet K is kept from dripping onto the continuous sheet P. However, the width may vary depending on the physical property of the ink and the material for forming the recovery hole. For example, the use of the ink with high viscosity allows the narrow receiving width because the ink droplet K hardly trickles. Conversely, the use of the ink in a nearly liquid state requires a sufficient receiving width to prevent the ink droplet K from dripping, and the use of the ink absorbable material for forming the recovery hole. As described above, the respective receiving widths of the receiving portions 104, 105 may be determined in accordance with the physical property of the ink and the material for forming the recovery hole.

According to the embodiment, the position of the opening 102 may be determined by satisfying at least two conditions as follows.

1) The opening 102 is formed at the position apart from the upstream wall surface W1 to the downstream direction by the distance corresponding to the width of the receiving portion 104 for receiving the ink droplet K trickling from the upstream wall surface W1 of the recovery hole 103. The opening 102 at the position allows introduction and recovery of the upstream ink mist, but hardly affects the upstream ink droplet required to be supplied for printing.

2) The opening 102 is formed at the position apart from the downstream wall surface W2 of the recovery hole 103 to the upstream direction so that the downstream suction air (arrows A3, A4) generates the air flow that obstructs the upstream ink mist flow, and blows the ink mist flow upward (arrow A2) for guiding into the recovery hole 103.

In the embodiment, the opening 102 is formed at substantially the center part of the ink mist recovery device 100 in the carrier direction F in consideration of the position of the adjacent inkjet head 21*a* at the upstream side, the position of the inkjet head 21*a* of the other head unit 21 at the downstream side, and the suction force of the suction unit so that the positional conditions are satisfied. The downstream suction air current flowing to the upstream direction serves to obstruct the ink mist flowing from upstream for guiding into the recovery hole 103 without affecting the operation for discharging the ink droplet to form the image. The ink mist is then introduced into the recovery hole 103 from the opening 102 together with air rather than flowing downward, and accordingly, securely recovered. Even if the ink mist introduced into the recovery hole 103 of the recovery casing 101 adheres to the wall surfaces W1, W2, and gathers thereon to trickle down as the ink droplet K, the receiving portions 104, 105 receive the ink droplet K. This makes it possible to prevent the ink droplet from dripping directly onto the continuous sheet P.

A modified example of the ink mist recovery device 100 installed in the inkjet printer according to the embodiment will be described referring to FIG. 3. As FIG. 3 corresponds to FIG. 2 illustrating the embodiment, the structures corresponding to those shown in FIG. 2 are designated with the same reference signs, and explanations thereof are applied by analogy.

Figure 3:
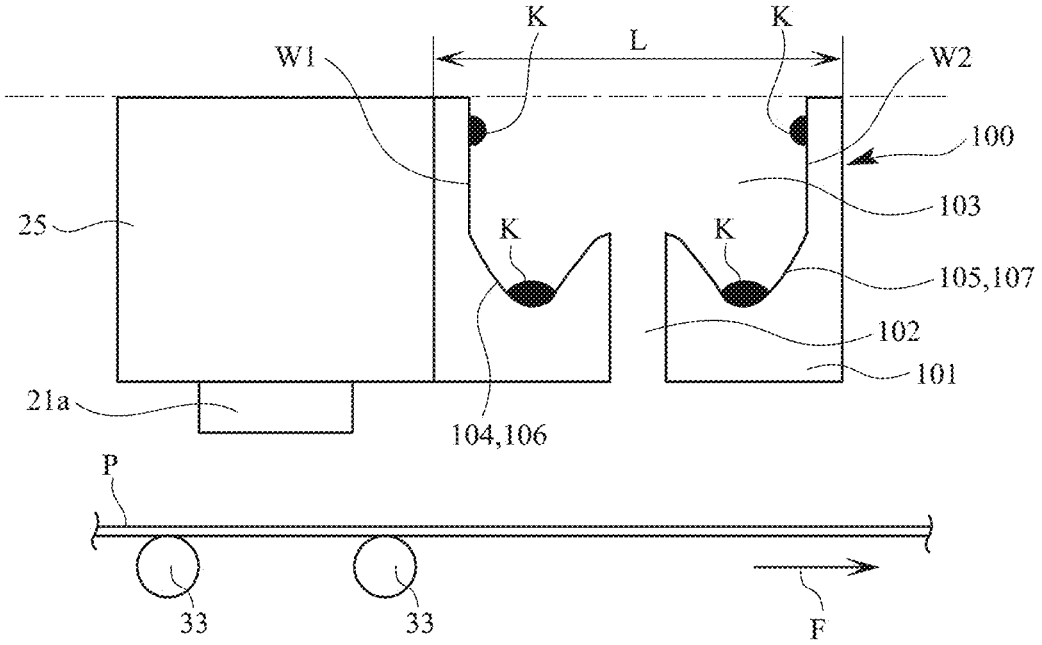
FIG. 3 is a sectional view of a modification of the ink mist recovery device installed in the inkjet printer according to the embodiment, taken along the vertical plane parallel to the sheet carrier direction.

As FIG. 3 shows, in the ink mist recovery device 100 according to the modified example, recess portions 106, 107 are formed in the upstream and downstream receiving portions 104, 105, respectively in the recovery hole 103 of the recovery casing 101. In the case where the ink mist introduced into the recovery hole 103 adheres to the wall surfaces W1, W2, and gathers thereon to trickle as the ink droplet K, the recess portions 106, 107 of the receiving portions 104, 105 securely receive and keep the ink droplet K. Since the droplet hardly overflows from the receiving portions 104, 105, the droplet may be prevented from dripping onto the continuous sheet P.

A specific effect of the inkjet printer 1 according to the embodiment will be described.

The inkjet printer 1 according to the embodiment has functions of unwinding and carrying the continuous sheet wound in the roll state (roll sheet) from the sheet feeder, printing a desired image on the sheet by the inkjet head, and winding the printed continuous sheet around the winding unit. Since the inkjet head used herein is a printing unit of contactless type for forming the image by discharging ink droplets onto the sheet, the ink mist is inevitably generated in printing. In the printer as described above, downward movement of the floating ink mist is obstructed by the continuous roll sheet. It is therefore necessary to install the ink mist recovery device for recovering the ink mist that has nowhere to go.

Even in the use of the suction type carrier device as the one for carrying the sheet while having the sheet stuck on the belt, the continuous belt-like roll sheet is carried to cover a major part of the suction hole of the belt for the air suction operation continuously. Therefore, it is unlikely that the ink mist floating above the roll sheet is sucked through the suction hole of the belt and removed. If the width of the roll sheet is smaller than that of the belt and the suction holes are opened at both ends of the belt in the width direction, the ink mist may be partially sucked through the suction hole. In the above-described condition, however, the ink mist floating above the sheet cannot be sufficiently recovered.

Accordingly, in the printer of type using the inkjet head to form the image on the roll sheet, unless the ink mist generated in printing is recovered immediately after printing, the downstream side may be affected. It is therefore preferable to dispose the ink mist recovery device close behind the downstream side of the inkjet head in the roll sheet carrier direction. In the inkjet printer 1 according to the embodiment, the ink mist recovery device is disposed close behind the downstream side of the inkjet head. As described above, even in the case where the liquid agent mist introduced into the recovery hole of the recovery casing adheres to the wall surface of the recovery hole, and gathers thereon to trickle as the droplet, the receiving portions receive the droplet to prevent dripping onto the sheet.

In the case of the printer of type using the inkjet head for forming the image on the cut sheet carried by the suction type carrier device unlike the inkjet printer 1 of the embodiment, the gap exists between the adjacent sheets while being carried. The gap exposes the suction hole formed in the belt for the air suction operation. Therefore, the ink mist floating above the sheet is expected to be sucked to a certain extent from the suction hole of the belt.

In the above-described embodiment, the inkjet printer 1 provided with the ink mist recovery device 100 has been explained. However, the ink mist recovery device 100 is only an example of the liquid agent mist recovery device according to the present invention. In addition to the exemplary case of the embodiment, the liquid agent mist recovery device according to the present invention is applicable to the pre-treatment liquid mist recovery device disposed in the sheet pre-treatment device, and the post-treatment liquid mist recovery device disposed in the post-treatment device for the printed sheet.

The sheet pre-treatment device is disposed at the upstream side of the print section of the inkjet printer as described above, and configured to apply the pre-treatment liquid to the sheet in the contactless manner. Execution of the pre-treatment may prevent the ink from being blurred as a result of infiltration into the sheet, and further improve fixing of the ink.

The sheet post-treatment device is disposed at the downstream side of the print section of the inkjet printer as described above, and configured to apply the post-treatment liquid to the printed sheet in the contactless manner. Execution of the post-treatment process may protect the newly formed image from being damaged owing to rubbing. It is also possible to make the image shiny for improving the appearance, and to further make the image stereoscopic by applying the post-treatment liquid only to the part where the image is formed.

Structure and Effect of Liquid Agent Mist Recovery Device According to Invention The liquid agent mist recovery device according to a first aspect of the invention is provided for a liquid agent application device that allows a discharge unit to discharge a liquid agent to a sheet carried in a carrier direction. The liquid agent mist recovery device is disposed at a downstream side of the discharge unit in the carrier direction, and includes a recovery casing including an opening for introducing a liquid agent mist generated when the discharge unit discharges the liquid agent together with air, and a recovery hole communicated with the opening, and a suction unit that is connected to the recovery hole of the recovery casing, and introduces the liquid agent mist together with air from the opening. The opening is apart from an upstream wall surface and a downstream wall surface of the recovery hole by an amount equal to or larger than a width of a receiving portion for receiving the liquid agent trickling from the upstream wall surface and the downstream wall surface.

In the liquid agent mist recovery device according to the first aspect, the liquid agent mist is generated upon discharging of the liquid agent from the discharge unit of the liquid agent application device, and then flows downstream. The liquid agent mist recovery device disposed at the downstream side of the liquid agent application device is capable of introducing the liquid agent mist into the recovery hole of the recovery casing with the suction force of the suction unit. Even if the introduced liquid agent mist adheres to the wall surface of the recovery hole, and gathers thereon to trickle as the droplet, the receiving portions receive the droplet. This makes it possible to prevent the droplet from directly dripping onto the sheet.

In the liquid agent mist recovery device according to a second aspect of the invention, the opening is apart from the downstream wall surface of the recovery hole to allow the air introduced from downstream side to obstruct the upstream liquid agent mist for guiding into the recovery hole.

In the liquid agent mist recovery device according to the second aspect, the air current to the upstream direction, which has been generated by air introduced from downstream by the liquid agent mist recovery device obstructs the liquid agent mist flowing from upstream for guiding into the recovery hole. The liquid agent mist flowing from upstream may be securely introduced into the recovery hole from the opening of the recovery casing with the suction force of the suction unit for recovery.

In the liquid agent mist recovery device according to a third aspect of the invention, a lower surface of the discharge unit that faces a sheet is continuous with a lower surface of the recovery casing.

In the liquid agent mist recovery device according to the third aspect, the air flows from the discharge unit to the liquid agent mist recovery device along the continuous lower surfaces of the discharge unit and the liquid agent mist recovery device. The air flow is brought into a stable linear flow to directly carry the liquid agent mist to the opening without generating a swirl that interferes with smooth transfer of the liquid agent mist.

DESCRIPTION OF REFERENCE SIGNS

1 inkjet printer as a liquid agent application device
10 unwinding unit
20 print section
21*a* inkjet head as a discharge unit
30 carrier section
40 winding unit
50 casing
60 dust remover
100 ink mist recovery device as a liquid agent mist recovery device
101 recovery casing
102 opening
103 recovery hole
104 upstream receiving portion
105 downstream receiving portion
P continuous sheet as a sheet
F sheet carrier direction
W1 upstream wall surface of recovery hole
W2 downstream wall surface of recovery hole
K ink droplet

What is claimed is:

1. A liquid agent mist recovery device for a liquid agent application device that allows a discharger to discharge a liquid agent to a sheet carried in a carrier direction, the liquid agent mist recovery device being disposed at a downstream side of the discharger in the carrier direction, comprising:

a recovery casing including an opening to introduce a liquid agent mist generated when the discharger discharges the liquid agent together with air, and a recovery hole communicated with the opening; and a suctioner that is connected to the recovery hole of the recovery casing, and the suctioner is configured to suction the liquid agent mist together with the air into the opening, wherein the opening is apart from an upstream wall surface and a downstream wall surface of the recovery hole by an amount equal to or larger than a width of a receiving portion to receive the liquid agent trickling from the upstream wall surface and the downstream wall surface, and wherein the opening does not protrude from a lower surface of the recovery casing.

2. The liquid agent mist recovery device according to claim 1, wherein the opening is apart from the downstream wall surface of the recovery hole to allow the air introduced from a downstream side of the opening to obstruct upstream liquid agent mist to be guided into the recovery hole.

3. The liquid agent mist recovery device according to claim 1, wherein a lower surface of the discharger that faces the sheet is continuous with the lower surface of the recovery casing.

4. The liquid agent mist recovery device according to claim 1, wherein a lower surface of the discharger and the lower surface of the recovery casing are laterally arranged relative to one another without a gap therebetween.

5. The liquid agent mist recovery device according to claim 1, wherein the suctioner is configured to suction the liquid agent mist together with the air to flow parallel to a lower surface of the discharger and the lower surface of the recovery casing.

6. The liquid agent mist recovery device according to claim 1, wherein the suctioner is configured to suction the liquid agent mist together with the air along a lower surface of the discharger and the lower surface of the recovery casing in a stable straight flow.

* * * * *